US005114565A

United States Patent [19]

Zones et al.

[11] Patent Number: 5,114,565

[45] Date of Patent: May 19, 1992

[54] REFORMING NAPHTHA WITH BORON-CONTAINING LARGE-PORE ZEOLITES

[75] Inventors: Stacey I. Zones, San Francisco; Dennis L. Holtermann, Crockett; Andrew Rainis, Walnut Creek, all of Calif.

[73] Assignee: Chevron Research and Technology Company, San Francisco, Calif.

[21] Appl. No.: 647,106

[22] Filed: Jan. 25, 1991

Related U.S. Application Data

[63] Continuation-in-part of Ser. No. 471,256, Jan. 26, 1990, abandoned, which is a continuation-in-part of Ser. No. 377,360, Jan. 7, 1989, abandoned.

[51] Int. Cl.[5] ..... C10G 35/06

[52] U.S. Cl. ..... 208/138; 208/134; 208/135; 208/136

[58] Field of Search ..... 208/134, 138

[56] References Cited

U.S. PATENT DOCUMENTS

| | | | |
|---|---|---|---|
| 4,268,420 | 5/1981 | Klotz | 208/135 |
| 4,327,236 | 4/1982 | Klotz | 208/136 |
| 4,584,089 | 4/1986 | Unmuth et al. | 208/138 |
| 4,839,027 | 6/1989 | Absil et al. | 208/138 |
| 4,936,977 | 6/1990 | Zones et al. | 208/138 |

*Primary Examiner*—Helane E. Myers
*Attorney, Agent, or Firm*—V. J. Cavalieri; C. E. Rincon

[57] ABSTRACT

Catalytic reforming processes using boron-containing large-pore zeolites.

31 Claims, 1 Drawing Sheet

REFORMING NAPHTHA WITH BORON-CONTAINING LARGE-PORE ZEOLITES

CROSS-REFERENCE TO RELATED APPLICATIONS

This application is a continuation-in-part of pending application U.S. Ser. No. 471,256, filed Jan. 26, 1990 now abandoned, which is a continuation-in-part of U.S. Ser. No. 377,360, filed Jul. 7, 1989, abandoned.

BACKGROUND OF THE INVENTION

Catalytic reforming is a process for treating naphtha fractions of petroleum distillates to improve their octane rating by producing aromatic components and isomerizing paraffins from components present in naphtha feedstocks. Included among the hydrocarbon reactions occurring in reforming processes are: dehydrogenation of naphthenes to aromatics, dehydrocyclization of paraffins to aromatics, and hydrocracking of paraffins to lighter gases with a lower boiling point than gasoline. Hydrocracking reactions which produce light paraffin gases are not desirable as they reduce the yield of products in the gasoline range.

Natural and synthetic zeolitic crystalline aluminosilicates and borosilicates are useful as catalysts. The use of ZSM-type catalysts and processes are described in U.S. Pat. Nos. 3,546,102, 3,679,575, 4,018,711 and 3,574,092. Zeolite L is also used in reforming processes as described in U.S. Pat. Nos. 4,104,320, 4,447,316, 4,347,394 and 4,434,311.

Borosilicate zeolites are especially useful in catalytic reforming. Methods for preparing high silica content zeolites that contain framework boron are described in U.S. Pat. No. 4,269,813.

The use of intermediate pore borosilicate zeolites for catalytic reforming is described in European Patent Application No. 188,913. In this application, ZSM-5, ZSM-11, ZSM-12, ZSM-23, ZSM-35, ZSM-38, ZSM-48 and zeolite beta have been identified as intermediate pore borosilicate zeolites.

A method for controlling catalytic activity of large-pore boron-containing zeolites is described in European Patent Application No. 234,759.

SUMMARY OF THE INVENTION

According to the present invention, a process is provided for catalytic reforming. The process comprises contacting a hydrocarbon feedstream under catalytic reforming conditions with a composition comprising large-pore borosilicate zeolites having a pore size between 6 and 8 angstroms. Preferably, the large-pore borosilicate zeolites are boron beta zeolite, (B)SSZ-24, SSZ-31 and SSZ-33.

Boron beta zeolite is described in commonly assigned co-pending application U.S. Ser. No. 377,359, entitled "Low-Aluminum Boron Beta Zeolite", the disclosure of which is incorporated herein by reference.

(B)SSZ-24 is described in commonly assigned co-pending application U.S. Ser. No. 377,357, entitled "Zeolite (B)SSZ-24", the disclosure of which is incorporated herein by reference.

SSZ-33 is described in U.S. Pat. No. 4,963,337, the disclosure of which is incorporated herein by reference.

SSZ-31 is described in commonly assigned co-pending application U.S. Ser. No. 471,158, entitled "New Zeolite SSZ-31", the disclosure of which is incorporated herein by reference.

According to a preferred embodiment, the large-pore borosilicate zeolites may be used in a multi-stage catalytic reforming process. These zeolites may be located in one or more of the reactors, with conventional platinum and rhenium catalysts located in the remaining reactors.

The reforming process may be accomplished by using fixed beds, fluid beds or moving beds for contacting the hydrocarbon feedstream with the catalysts.

Among other factors, the present invention is based on our finding that large-pore borosilicates including boron beta zeolite [(B)Beta], SSZ-33, (B)SSZ-24 and SSZ-31 have unexpectedly outstanding reforming properties. These include high sulfur tolerance, high catalyst stability, and high catalyst activity.

DETAILED DESCRIPTION OF THE INVENTION

Figure 1:
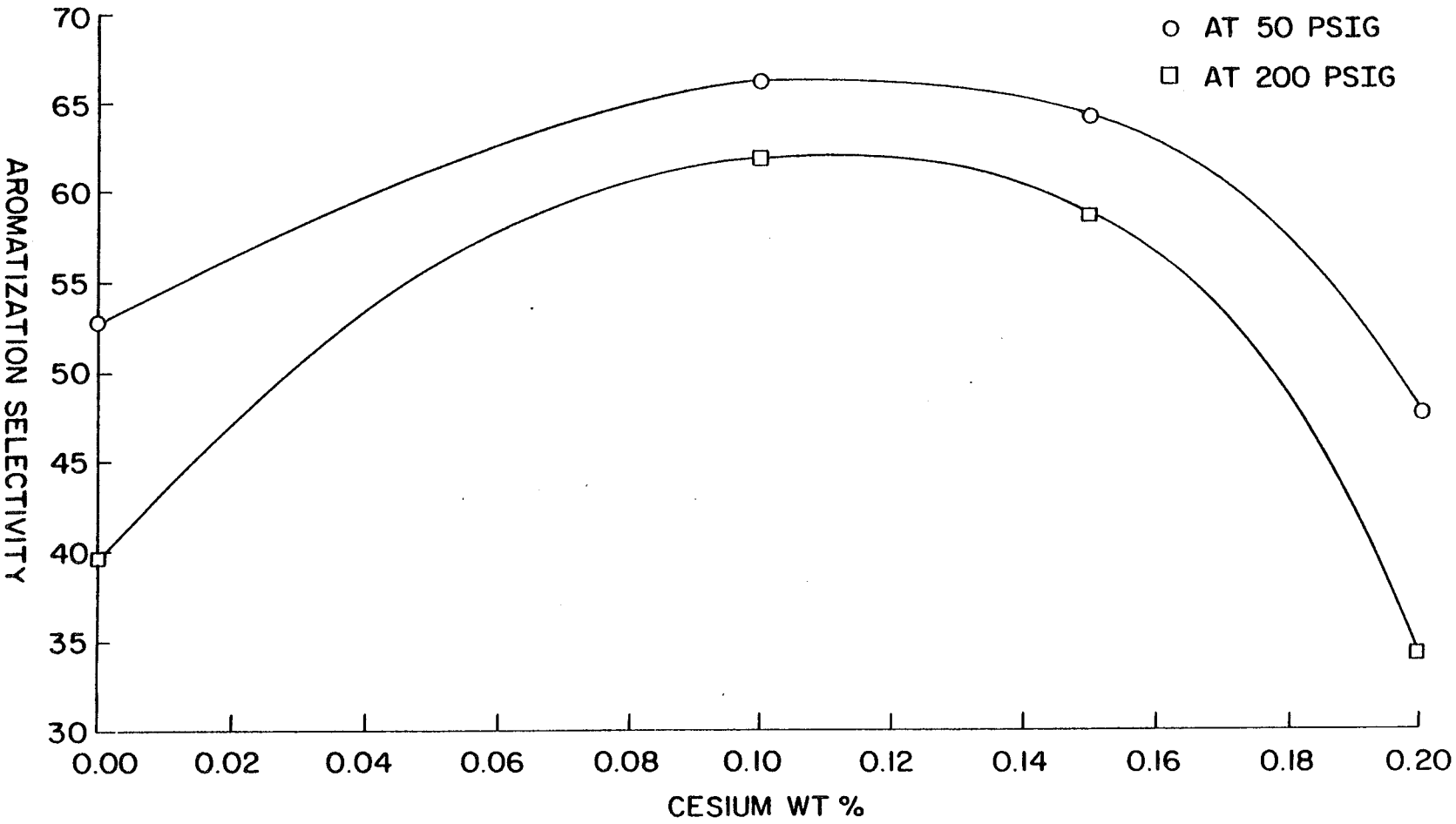

The present invention relates to reforming processes employing large-pore borosilicate zeolites. A large-pore zeolite is defined herein as a zeolite having a pore size between 6 and 8 angstroms. A method of determining this pore size is described in *Journal of Catalysis* (1986); Vol. 99, p. 335 (D. S. Santilli). A large-pore zeolite may be identified by using the pore probe technique described in *Journal of Catalysis* (1986); Vol. 99, p. 335 (D. S. Santilli). This method allows measurement of the steady-state concentrations of compounds within the pores of materials. 2,2-dimethylbutane (22DMB) enters the large pores and the concentration in the pores is measured using this technique.

According to preferred embodiments of our invention, SSZ-33, (B)SSZ-24, SSZ-31 and low-aluminum boron beta zeolite [(B)beta] are large-pore borosilicate zeolites with high catalyst activity in the reforming process.

SSZ-33 is defined as a zeolite having a mole ratio of an oxide selected from silicon, germanium oxide and mixtures thereof to an oxide selected from boron oxide or mixtures of boron oxide with aluminum oxide, gallium oxide or iron oxide, greater than about 20:1 and having the X-ray diffraction lines of Table 1. The X-ray diffraction lines of Table 1 correspond to the calcined SSZ-33.

TABLE 1

| 2 Θ | d/n | 100 × $I/I_o$ |
|---|---|---|
| 7.86 | 11.25 | 90 |
| 20.48 | 4.336 | 100 |
| 21.47 | 4.139 | 40 |
| 22.03 | 4.035 | 90 |
| 23.18 | 3.837 | 64 |
| 26.83 | 3.323 | 40 |

(B)SSZ-24 is defined as a zeolite having a mole ratio of an oxide from silicon oxide, germanium oxide, and mixtures thereof to an oxide selected from boron oxide or mixtures of boron oxide with aluminum oxide, gallium oxide, and iron oxide, between 20:1 and 100:1 and having the X-ray diffraction lines of Table 2. The X-ray diffraction lines of Table 2 correspond to the calcined (B)SSZ-24.

TABLE 2

| 2 Θ | d/n | 100 × $I/I_o$ |
|---|---|---|
| 7.50 | 11.79 | 100 |
| 13.00 | 6.81 | 16 |

TABLE 2-continued

| 2 Θ | d/n | 100 × I/I$_o$ |
|---|---|---|
| 15.03 | 5.894 | 8 |
| 19.93 | 4.455 | 35 |
| 21.42 | 4.148 | 48 |
| 22.67 | 3.922 | 60 |
| 25.15 | 3.541 | 3 |
| 26.20 | 3.401 | 22 |
| 29.38 | 3.040 | 12 |
| 30.43 | 2.947 | 12 |

Boron beta zeolite is a zeolite having a mole ratio of an oxide selected from silicon oxide, germanium oxide, and mixtures thereof to an oxide selected from boron oxide, or mixtures of boron oxide with aluminum oxide, gallium oxide or iron oxide, greater than 10:1 and wherein the amount of aluminum is less than 0.10% by weight and having the X-ray diffraction lines of Table 3. The X-ray diffraction lines of Table 3 correspond to the calcined boron beta zeolite.

TABLE 3

| 2 Θ | d/n | 100 × I/I$_o$ | Shape |
|---|---|---|---|
| 7.7 | 11.5 | 85 | Broad |
| 13.58 | 6.52 | 9 | |
| 14.87 | 5.96 | 12 | Broad |
| 18.50 | 4.80 | 3 | Very Broad |
| 21.83 | 4.07 | 15 | |
| 22.87 | 3.89 | 100 | Broad |
| 27.38 | 3.26 | 10 | |
| 29.30 | 3.05 | 6 | Broad |
| 30.08 | 2.97 | 8 | |

SSZ-31 is defined as a zeolite having a mole ratio of an oxide selected from silicon oxide, germanium oxide, and mixtures thereof to an oxide selected from aluminum oxide, gallium oxide, iron oxide, and mixtures thereof greater than about 50:1, and having the X-ray diffraction lines of Table 4. The X-ray diffraction lines of Table 4 correspond to the calcined SSZ-31.

TABLE 4

| 2 Θ | d/n | 100 × I/I$_o$ | Shape |
|---|---|---|---|
| 6.08 | 14.54 | 9 | |
| 7.35 | 12.03 | 9 | |
| 8.00 | 11.05 | 7 | Broad |
| 18.48 | 4.80 | 11 | |
| 20.35 | 4.36 | 9 | Broad |
| 21.11 | 4.21 | 100 | |
| 22.24 | 4.00 | 56 | |
| 24.71 | 3.60 | 21 | |
| 30.88 | 2.90 | 7 | |

The large-pore borosilicates can be used as reforming catalysts to convert light straight run naphthas and similar mixtures to highly aromatic mixtures. Thus, normal and slightly branched chained hydrocarbons, preferably having a boiling range above about 40° C. and less than about 250° C., can be converted to products having a substantial aromatics content by contacting the hydrocarbon feed with the zeolite at a temperature in the range of from about 350° C. to 600° C., at pressures ranging from atmospheric to 20 atmospheres, LHSV ranging from 0.1 to 15, and a recycle hydrogen to hydrocarbon ratio of about 1 to 10.

The reforming catalyst preferably contains a Group VIII metal compound to have sufficient activity for commercial use. By Group VIII metal compound as used herein is meant the metal itself or a compound thereof. The Group VIII noble metals and their compounds, platinum, palladium, and iridium, or combinations thereof can be used. The most preferred metal is platinum. The amount of Group VIII metal present in the conversion catalyst should be within the normal range of use in reforming catalysts, from about 0.05 to 2.0 wt. percent, preferably 0.2 to 0.8 wt. percent. In addition, the catalyst can also contain a second Group VII metal. Especially preferred is rhenium.

The zeolite/Group VIII metal catalyst can be used with or without a binder or matrix. The preferred inorganic matrix, where one is used, is a silica-based binder such as Cab-O-Sil or Ludox. Other matrices such as alumina, magnesia and titania can be used. The preferred inorganic matrix is nonacidic.

It is critical to the selective production of aromatics in useful quantities that the conversion catalyst be partially neutralized, for example, by exchanging the sites in the zeolite with metal ions, e.g., Group I and Group II ions. The zeolite is usually prepared from mixtures containing alkali metal hydroxides and thus, have alkali metal contents of about 1–2 wt. %. These high levels of alkali metal, usually sodium or potassium, are unacceptable for most other catalytic applications because they deactivate the catalyst for cracking reactions by reducing catalyst acidity. Therefore, the alkali metal is removed to low levels by ion exchange with hydrogen or ammonium ions. By alkali metals as used herein is meant ionic alkali metals or their basic compounds. Surprisingly, unless the zeolite itself is already partially neutralized, the alkali metal is required in the present process to reduce acidity and improve aromatics production. Alkali metals are incorporated by impregnation or ion exchange using nitrate, chloride, hydroxide or carbonate salts.

The amount of alkali metal necessary to decrease the acidity of the large-pore zeolite can be calculated using standard techniques based on the aluminum, gallium or iron content of the zeolites. If a large-pore zeolite free of alkali metal is the starting material, alkali metal ions can be ion-exchanged into the zeolite to partially reduce the acidity of the zeolite. We have found that by incorporating Group IA or Group IIA metal cations into a large-pore zeolite containing a Group VIII metal, such that the molar ratio of aluminum to the Group IA or Group IIA metal cation is between 1.0 and 4.0, the acidity of the zeolite is partially reduced and the catalyst performs well as a reforming catalyst.

The preferred Group IA metals are cesium, lithium, potassium and sodium. The preferred Group IIA metals are barium, calcium, magnesium and strontium.

Most preferably, the catalyst used in the reforming process comprises a large-pore borosilicate containing platinum and cesium and having a molar ratio of aluminum to cesium between 1.0 and 2.0.

Reforming catalysts in current use are made substantially free of acidity, to reduce the tendency toward excessive cracking, leading to low liquid yields. Treating an acid catalyst with an alkali metal has been used effectively in eliminating acidity. We have now discovered that there is a criticality in the catalyst acidity which leads to good performance in reforming processes. This criticality is achieved by treating the catalyst during catalyst preparation with an effective amount of Group IA or Group IIA metal cations such that the molar ratio of aluminum to Group IA or Group IIA metal cations is between 1.0 and 4.0.

Catalysts which are prepared such that this acid criticality is maintained have higher activity and stability for reforming reactions. They can therefore be operated at lower temperatures and pressures, which results in longer catalyst cycle times and more stable catalyst operation.

The lower catalyst temperatures have other consequences which are important for reforming reactions. Dealkylation reactions which remove the alkyl substituents from alkyl aromatics are reduced at lower reaction temperatures. Dehydrocyclization of hexane to benzene is also reduced. The consequence of reducing these reactions is that the amount of benzene produced by the process of this invention is reduced relative to the formation of the more desirable alkyl substituted aromatics.

Another benefit of the catalysts of this invention is its ability to increase the amount of isoparaffins, relative to normal paraffins, when compared with other reforming catalysts known in the art. In general, isoparaffins have higher octane than do the corresponding normal paraffin isomers. Octane number is determined using one of a number of methods, including the Research method (ASTM D 2699) and the Motor method (ASTM D 2700). With isoparaffins, such as isobutane, which are used as feedstocks for other hydrocarbon processing, the branched isomers are of much higher value than the normal paraffins, and are therefore preferred as constituents in the products from reforming reactions. Determining the isobutane/normal butane ratio in reforming products is a standard procedure using, for example, gas chromatographic techniques.

The catalyst of this invention, by reason of having a molar ratio of aluminum to Group IA or Group IIA metal cations between 1.0 and 4.0, produces low amounts of methane and ethane when used in reforming operations. Thus, the high hydrogen consumption associated with methane and ethane production, which is characteristic of current reforming processes, is avoided in the process of this invention. Furthermore, the low amounts of methane and ethane formed during the process of this invention results in high purity hydrogen produced by the process in comparison to the current reforming processes.

A low sulfur feed is preferred in the reforming process; but due to the sulfur tolerance of these catalysts, feed desulfurization does not have to be as complete as with conventional reforming catalysts. The feed should contain less than 10 parts per million sulfur. In the case of a feed which is not low enough in sulfur, acceptable levels can be reached by hydrodesulfurizing the feed with a desulfurizing catalyst. An example of a suitable catalyst for this hydrodesulfurization process is an alumina-containing support and a minor catalytic proportion of molybdenum oxide, cobalt oxide and/or nickel oxide. A platinum on alumina hydrogenating catalyst can also work. In which case, a sulfur sorber is preferably placed downstream of the hydrogenating catalyst, but upstream of the present reforming catalyst. Examples of sulfur sorbers are alkali or alkaline earth metals on porous refractory inorganic oxides, zinc, etc. Hydrodesulfurization is typically conducted at 315°–455° C., at 200–2000 psig, and at a LHSV of 1–5.

It is preferable to limit the nitrogen level and the water content of the feed. Catalysts and processes which are suitable for these purposes are known to those skilled in the art.

After a period of operation, the catalyst can become deactivated by coke. Coke can be removed by contacting the catalyst with an oxygen-containing gas at an elevated temperature. If the Group VIII metal(s) have agglomerated, then it can be redispersed by contacting the catalyst with a chlorine gas under conditions effective to redisperse the metal(s). The method of regenerating the catalyst may depend on whether there is a fixed bed, moving bed, or fluidized bed operation. Regeneration methods and conditions are well known in the art.

The reforming catalysts preferably contain a Group VIII metal compound to have sufficient activity for commercial use. By Group VIII metal compound as used herein is meant the metal itself or a compound thereof. The Group VIII noble metals and their compounds, platinum, palladium, and iridium, or combinations thereof can be used. Rhenium and tin may also be used in conjunction with the noble metal. The most preferred metal is platinum. The amount of Group VIII metal present in the conversion catalyst should be within the normal range of use in reforming catalysts, from about 0.05–2.0 wt. %.

EXAMPLE 1

Preparation of Platinum-(B)SSZ-24

The borosilicate version of (B)SSZ-24 was prepared for use as a reforming catalyst. The zeolite powder was impregnated with $Pt(NH_3)_4.2NO_3$ to give 0.8 wt. % Pt. The material was calcined up to 550° F. in air and maintained at this temperature for three hours. The powder was pelletized on a Carver press at 1000 psi and broken and meshed to 24–40

EXAMPLE 2

Reforming Test Results (B)SSZ-24 from Example 1 was tested as a reforming catalyst. The conditions for the reforming test were as follows. The catalyst was prereduced for 1 hour in flowing hydrogen at 950° F. and atmospheric pressure. Test conditions were:

| |
|---|
| Total Pressure = 200 psig |
| $H_2$/HC Molar Ratio = 6.4 |
| WHSV = 6 $hr^{-1}$ |

The catalyst was initially tested at 800° F. and then at 900° F. The feed was an isoheptane mixture supplied by Philips Petroleum Company. The catalyst from Example 1 was tested with these results.

| | Feed | Products | |
|---|---|---|---|
| Temperature, °F. | | 800° F. | 900° F. |
| Conversion % | 0 | 79.6 | 100 |
| Toluene, wt. % | 0.5 | 22.1 | 21.9 |
| $C_5$–$C_8$ Octane, RON | 63.7 | 86.8 | 105.2 |
| $C_{5+}$ Yield, wt. % | 100 | 54.9 | 35.4 |
| Aromatization Selectivity, % | | 32.1 | 30.2 |
| Toluene in the $C_{5+}$ Aromatics % | | 86.6 | 72.7 |

As shown by the complete conversion, this catalyst is capable of converting all types of feedstock molecules.

EXAMPLE 3

Preparation and Testing of a Neutralized Platinum-Aluminum-Boron SSZ-24

Aluminum was substituted into the borosilicate version of (B)SSZ-24 by refluxing the zeolite with an equal mass of $Al(NO_3)_3.9H_2O$ overnight. Prior to use, the aluminum nitrate was dissolved in $H_2O$ at a ratio of 50:1. The product contained acidity due to the aluminum incorporation, and this would lead to unacceptable cracking losses. Two back ion exchanges with $KNO_3$ were performed and the catalyst was calcined to 1000° F. Next, a reforming catalyst was prepared as in Example 1. It was tested as in Example 2.

| | Feed | Products | |
|---|---|---|---|
| Temperature, °F. | | 800 | 900 |
| Conversion % | 0 | 53.0 | 95.1 |
| Toluene, wt. % | 0.5 | 22.6 | 26.6 |
| $C_5$-$C_8$ Octane, RON | 63.7 | 78.1 | 99.6 |
| $C_{5+}$ Yield, wt. % | 100 | 81.5 | 46.2 |
| Aromatization Selectivity, % | | 47.1 | 35.7 |
| Toluene in the $C_{5+}$ Aromatics % | | 90.6 | 78.1 |

By comparison with Example 2, the incorporation of aluminum, accompanied by its neutralization, gives a less active, but more selective catalyst.

EXAMPLE 4

Preparation and Testing of a Platinum-Boron-Beta Catalyst

The borosilicate version of boron beta was impregnated with $Pt(NH_3)_4.2NO_3$ to give 0.8 wt. % Pt. The material was calcined up to 550° F. in air and maintained at this temperature for three hours. The powder was pelletized on a Carver press at 1000 psi and broken and meshed to 24–40. The catalyst was tested as shown in Example 2 with the exception that operation at both 200 and 50 psig were explored.

| | | | |
|---|---|---|---|
| Pressure, psig | 200 | 50 | 200 |
| Temperature, °F. | 800 | 800 | 900 |
| Conversion % | 88.8 | 77.0 | 100 |
| Toluene, wt. % | 19.1 | 39.3 | 16.9 |
| $C_5$-$C_8$ Octane, RON | 89.5 | 90.6 | 104.3 |
| $C_{5+}$ Yield, wt. % | 46.9 | 77.4 | 30.2 |
| Aromatization Selectivity, % | 25.4 | 54.5 | 25.3 |
| Toluene in the $C_{5+}$ Aromatics % | 84.9 | 93.7 | 67.8 |

The catalyst is quite stable and the values are averaged over at least 20 hours of run time.

EXAMPLE 5

Preparation and Testing of a Platinum-Cobalt-Boron-Beta Catalyst

Cobalt was incorporated into the boron beta as described in Example 3 with $Co(NO_3)_2.6H_2O$ as the cobalt source replacing $Al(NO_3)_3.9H_2O$ as the aluminum source in Example 3. The catalyst was calcined to 1000° F., and a Platinum reforming catalyst was prepared as described in Example 1. It was tested as described in Example 2 except the WHSV was 12 and operation at both 200 and 100 psig was evaluated.

| | | |
|---|---|---|
| Pressure, psig | 200 | 100 |
| Temperature, °F. | 800 | 800 |
| Conversion % | 83.3 | 86.0 |
| Toluene, wt. % | 18.8 | 27.3 |
| $C_5$-$C_8$ Octane, RON | 85.3 | 90.3 |
| $C_{5+}$ Yield, wt. % | 59.8 | 63.7 |
| Aromatization Selectivity, % | 27 | 37 |
| Toluene in the $C_{5+}$ Aromatics % | 83.3 | 85.9 |

By comparison with Example 4, the incorporating of cobalt gives a more active catalyst. The catalyst has good stability at 800° F.

EXAMPLE 6

Preparation of Pt-SSZ-33

SSZ-33 was prepared for use as a reforming catalyst. The zeolite powder was impregnated with $Pt(NH_3)_4.2NO_3$ to give 0.8 wt. % Pt. The material was calcined up to 550° F. in air and maintained at this temperature for three hours. The powder was pelletized on a Carver press at 1000 psi and broken and screened to 24–40 mesh.

EXAMPLE 7

Preparation of Pt-Zinc-SSZ-33

Zinc was incorporated into the novel large-pore borosilicate SSZ-33 by refluxing $Zn(Ac)_2.H_2O$ as described in Example 3. The product was washed, dried, and calcined to 1000° F., and then impregnated with $Pt(NH_3)_4.2NO_3$ to give 0.8 wt. % Pt. The material was calcined up to 550° F. in air and maintained at this temperature for three hours. The powder was pelletized on a Carver press at 1000 psig, broken, and meshed to 24–40. It was tested as described in Example 2. Results are as follows:

| | |
|---|---|
| Pressure, psig | 200 |
| Temperature, °F. | 900 |
| Conversion % | 71.1 |
| Toluene, wt. % | 28 |
| $C_5$-$C_8$ Octane, RON | 85 |
| $C_{5+}$ Yield, wt. % | 74.2 |
| Aromatization Selectivty, % | 44.5 |
| Toluene in the $C_{5+}$ Aromatics % | 88.5 |

EXAMPLE 8

Testing of Pt-SSZ-33 and Pt-Zinc-SSZ-33

The catalysts of Examples 6 and 7 were tested with a partially reformed naphtha at:

| |
|---|
| Total Pressure = 50 psig |
| $H_2$/HC Molar Ratio = 3 |
| LHSV = 2 $hr^{-1}$ |

These conditions simulate use of the catalyst in the last reactor of a multi-stage reforming process. An analysis of the feed and products is shown below.

| | Feed | Products | |
|---|---|---|---|
| Molecular Sieve | | Pt-SSZ-33 | Pt—Zn-SSZ-33 |
| Temperature, °F. | | 780 | 860 |
| Composition, wt. % | | | |
| $C_4$– | 0 | 13.4 | 9.4 |
| $C_5$'s Total | 0 | 8.3 | 7.0 |
| $C_6$ Paraffins | 8.7 | 8.3 | 7.7 |
| $C_6$ Naphthenes | 1.0 | 0.9 | 0.9 |

-continued

| | Feed | Products | |
|---|---|---|---|
| Benzene | 1.6 | 3.5 | 2.6 |
| $C_7$ Paraffins | 8.6 | 2.9 | 4.5 |
| $C_7$ Naphthenes | 0.2 | 0.1 | 0 |
| Toluene | 8.8 | 13.3 | 11.6 |
| $C_8$ Paraffins | 5.8 | 0.5 | 0 |
| $C_8$ Naphthenes | 0.1 | 0 | 0 |
| $C_8$ Aromatics | 21.1 | 22.7 | 23.8 |
| $C_9$ Paraffins | 2.1 | 0 | 0 |
| $C_{9+}$ Aromatics | 32.3 | 26.4 | 31.4 |
| Octane, RON | 94.6 | 101.0 | 101.0 |
| $C_{5+}$ Yield, LV % of the Feed | 100.0 | 86.0 | 89.0 |

These examples illustrate the ability of both catalysts to upgrade partially reformed naphtha. Incorporation of zinc improves the liquid product selectivity, apparently by reducing dealkylation of existing aromatics.

EXAMPLE 9

Comparison of Unsulfided and Sulfided Platinum Boron Beta

The borosilicate version of Beta was impregnated with $Pt(NH_3)_4.2NO_3$ as in Example 4. The catalyst was sulfided at 950° F. for 1 hour in the presence of hydrogen.

Test conditions were:

| |
|---|
| Temperature = 800° F. |
| $H_2$/HC Molar Ratio = 6.4 |
| WHSV = 6 |

| | Unsulfiede Pt/(B) beta | | Sulfided Pt/(B) beta | |
|---|---|---|---|---|
| Pressure, psig | 200 | 200 | 200 | 200 |
| Time, hrs. | 3 | 18 | 3 | 18 |
| Feed Conversion, % | 96.9 | 95.8 | 79.1 | 81.6 |
| $C_{5+}$ Yield, wt. % | 37.6 | 40.2 | 59.4 | 57.0 |
| Calculated RON | 93.0 | 92.8 | 87.5 | 88.4 |
| Aromatization Selectivity, % | 19.4 | 21.3 | 35.2 | 34.0 |

EXAMPLE 10

Comparison of Sulfided Pt/(B)beta and Sulfided Pt/(B)beta with 52% $SiO_2$ Binder

| 800° F. 200 psig, 6 WHSV, 6.4 $H_2$:HC | | | | |
|---|---|---|---|---|
| | Pt/(B) beta | | Bound Pt/(B) beta | |
| Time, hrs | 3 | 18 | 3 | 18 |
| Feed Conversion, % | 79.1 | 81.6 | 52.7 | 57.7 |
| $C_{5+}$ Yield, wt. % | 59.4 | 57.0 | 86.5 | 82.1 |
| Calculated RON | 87.5 | 88.4 | 79.5 | 80.2 |
| Aromatization Selectivity | 35.2 | 34.0 | 52.9 | 47.0 |

| 800° F., 50 psig, 6 WHSV, 6.4 $H_2$:HC | | | | |
|---|---|---|---|---|
| | Pt/(B) beta | | Bound Pt/(B) beta | |
| Time, hrs | 3 | 18 | 3 | 18 |
| Feed Conversion, % | 87.9 | 86.5 | 62.6 | 61.5 |
| $C_{5+}$ Yield, wt. % | 64.3 | 66.0 | 84.4 | 85.0 |
| Calculated RON | 97.8 | 96.5 | 84.4 | 83.7 |
| Aromatization Selectivity | 50.8 | 51.5 | 56.3 | 55.5 |

-continued

| 800° F., 50 psig, 6 WHSV, 6.4 $H_2$:HC | | |
|---|---|---|
| | Pt/(B) beta | Bound Pt/(B) beta |

EXAMPLE 11

Comparison of Sulfided Pt/(B)beta and Sulfided Pt/Cs-(Al)-(B)beta

| 800° F., 200 psig, 6 WHSV, 6.4 $H_2$:HC* | | |
|---|---|---|
| | Pt/(B) beta | Pt/Cs—(Al)—(B) beta |
| Feed Conversion, % | 79.6 | 48.0 |
| $C_{5+}$ Yield, wt. % | 59.7 | 93.7 |
| Calculated RON | 87.9 | 77.0 |
| Propane + Butanes, wt. % | 18.8 | 2.3 |
| Toluene, wt. % | 25.6 | 25.9 |
| Arom. Selectivity | 35.7 | 56.0 |

*Data averaged for first five hours.

| 800° F., 50 psig, 6 WHSV, 6.4 $H_2$:HC** | | | | |
|---|---|---|---|---|
| | Pt/(B) Beta | | Pt/Cs—(Al)—(B) beta | |
| Time, hrs. | 3 | 18 | 3 | 18 |
| Feed Conversion, % | 87.9 | 86.5 | 46.0 | 40.0 |
| $C_{5+}$ Yield, wt. % | 64.3 | 66.0 | 95.0 | 96.0 |
| Calculated RON | 97.8 | 96.5 | 77.0 | 74.5 |
| Arom. Selectivity | 50.8 | 51.5 | 59.5 | 58.0 |
| Propane + Butanes, wt. % | 31.4 | 28.1 | 3.3 | 2.5 |
| Toluene, wt. % | 42.0 | 41.8 | 26.0 | 22.0 |

**Interpolated data.

EXAMPLE 12

Preparation and Testing of Pt-Boron-SSZ-31

The borosilicate version of SSZ-31 was prepared for use as a reforming catalyst. The zeolite powder was impregnated with $Pt(NH_3)_4.2NO_3$ to give 0.7 wt. % Pt. The material was calcined up to 600° F. in air and maintained at this temperature for three hours. The powder was pelletized on a Carver press at 1000 psi, broken, and screened to 24–40 mesh.

Pt-Boron-SSZ-31 was tested for reforming using an isoheptane feed mixture (Phillips Petroleum Company) as follows:

| | Feed | Run 1 | Run 2 |
|---|---|---|---|
| Reaction Conditions | | | |
| Temperature, °F. | | 800 | 800 |
| Total pressure, psig | | 200 | 50 |
| $H_2$/Hydrocarbon Mole Ratio | | 6.4 | 6.4 |
| Feed rate, WHSV, $hr^{-1}$ | | 6 | 6 |
| Results | | | |
| Conversion, % | 0 | 68.1 | 69.7 |
| Aromatization Select. | 0 | 39.4 | 54.7 |
| Toluene, wt. % | 0.7 | 24.6 | 36.0 |
| $C_5$–$C_8$ Octane, RON | 63.9 | 82.8 | 87.6 |

EXAMPLE 13

Preparation of Boron Beta Zeolite 48 grams of DABCO (1,4 Diazabicyclo [2.2.2]octane) is stirred into 800 ml of Ethyl Acetate. 42 grams of 1,4 Diiodobutane is added dropwise and slowly while the reaction is stirred. Allowing the reaction to run for a few days at room temperature produces a high yield of the precipitated diquaternary compound,

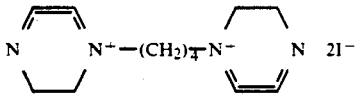

The product is washed with THF and then ether and then vacuum dried. Melting point = 255° C.

The crystalline salt is conveniently converted to the hydroxide form by stirring overnight in water with AGI-X8 hydroxide ion exchange resin to achieve a solution ranging from 0.25–1.5 molar. 202 grams of a 0.84M solution of the diquaternary compound is mixed with 55 grams of $H_2O$, and 4.03 grams of $Na_2B_4O_7.10H_2O$. 35 grams of Cabosil M5 is blended in last and the reaction is run in a Parr 600-cc stirred autoclave with liner for 6 days at 150° C. and stirred at 50 rpm. The product is well-crystallized Na form of the boron beta zeolite. The boron beta zeolite is calcined to 100° F. for 4 hours in nitrogen, which contains 1–2% air, flowing over the zeolite bed.

An $NH_4^+$ boron beta zeolite was used in preparing a reforming catalyst. The $NH_4^+$ boron beta zeolite is prepared by ion exchanging the calcined Na form of the boron beta zeolite using $NH_4NO_3$ to convert the zeolite from Na form to $NH_4^+$.

Typically, the same mass of $NH_4CH_3COO$ as zeolite was slurried into $H_2O$ at ratio of 50:1 $H_2O$ zeolite. The exchange solution was heated at 100° C. for two hours and then filtered. This process was repeated two times. Finally, after the last exchange, the zeolite was washed several times with $H_2O$ and dried.

EXAMPLE 14

Preparation of Pt-Cs Boron Beta

A platinum/cesium boron beta zeolite was prepared by ion exchange of a dilute solution of cesium chloride into the $NH_4^+$ boron beta zeolite described in Example 13. After washing the zeolite with deionized water and air drying overnight, the exchanged catalyst was further exchanged with a dilute solution of tetrammine platinum (II) chloride $[Pt(NH_3)_4Cl_2]$. The further exchanged catalyst was then dried at 250° F. in flowing dry air and then calcined at 550° F. in dry air to decompose the platinum tetrammine cation.

EXAMPLE 15

Preparation of Pt-Cs Boron Beta

A second platinum/cesium boron beta was prepared by ion exchange of a dilute mixed solution of cesium chloride and tetrammine platinum (II) chloride $[Pt(NH_3)_4Cl_2]$ into an $NH_4^+$ boron beta zeolite prepared using the method described in Example 13. After washing the exchanged zeolite with deionized water and air drying overnight, it was dried at 250° F. in flowing dry air and then calcined at 550° F. in dry air to decompose the platinum tetrammine cation.

EXAMPLE 16

Testing of Pt-Cs Boron Beta Catalysts for Reforming

A number of platinum/cesium boron beta reforming catalysts were prepared by the method of Example 15 to contain nominally 0.4 wt. % Pt and varying amounts of cesium, ranging from no cesium to 1.0 wt. % cesium. Each calcined catalyst was reduced at 950° F. in 300 ml/min hydrogen for one hour and then sulfided for one hour at 800° F. with a solution of dimethyldisulfide in hexane (containing 200 ppm sulfur) prior to testing. The feed was a mixture of purified isoheptanes with the composition shown below:

| | |
|---|---|
| n-Heptane | 10.8 wt. % |
| 2-Methylhexane | 20.7 wt. % |
| 3-Methylhexane | 20.8 wt. % |
| 2,3-Dimethylpentane | 8.5 wt. % |
| 3,3-Dimethylpentane | 0.7 wt. % |
| 1,1-Dimethylcyclopentane | 5.1 wt. % |
| cis 1,3-Dimethylcyclopentane | 9.2 wt. % |
| trans 1,3-Dimethylcyclopentane | 8.6 wt. % |
| trans 1,2-Dimethylcyclopentane | 12.2 wt. % |
| Methylcyclohexane | 2.9 wt. % |
| Cyclohexane | 0.7 wt. % |
| Ethylcyclopentane | 0.1 wt. % |
| Toluene | 0.5 wt. % |

Run conditions were as follows:

| | |
|---|---|
| WHSV | 6.0 |
| $H_2$/HC | 6.4 |
| Pressure | 200 psig. then 50 psig |
| Temperature | 800° F. |

The test was run for 23 hours at 200 psig/800° F., then was reduced to 50 psig to check on low pressure stability. Run length was usually 50–100 hours. Reaction products were analyzed by gas chromatography.

FIG. 1 shows the range of cesium loading on platinum boron beta zeolites which give the good aromatization selectivity, where aromatization selectivity = 100 X (% aromatics in product ÷ % total conversion). The data included in Tables 5 and 6 support this figure. Tables 7 and 8, which show the effect of equimolar amounts of Group IA and Group IIA metal cations on platinum/boron beta catalysts for reforming, illustrate that all of the Group IA and Group IIA metals are effective for improving the performance of platinum/-boron beta catalysts.

TABLE 5

Pt/B-beta Reforming Catalysts Containing Cesium

| | No Cesium | | 0.1 wt. % Cesium | | 0.15 wt. % Cesium | |
|---|---|---|---|---|---|---|
| Reaction Temperature, °F. | 800 | 800 | 800 | 800 | 800 | 800 |
| Reaction Pressure, psig | 200 | 50 | 200 | 50 | 200 | 50 |
| Dimethylcyclopentane Conversion, % | 94.2 | 99.4 | 90.4 | 95.9 | 90.9 | 97.0 |
| Total Feed Conversion, % | 72.1 | 83.3 | 49.5 | 55.8 | 50.3 | 58.6 |
| Aromatization Selectivity, % | 39.7 | 52.7 | 62.0 | 66.3 | 58.9 | 64.4 |
| Product Analysis | | | | | | |
| Butanes, wt. % | 17.17 | 15.49 | 4.83 | 5.58 | 4.70 | 5.27 |
| $C_{5+}$ Yield, wt. % | 67.30 | 68.80 | 89.60 | 87.80 | 89.60 | 87.90 |
| Research Octane (calc.) | 85.10 | 95.00 | 79.80 | 83.40 | 79.60 | 84.20 |
| Aluminum, wt. % | 0.06 | 0.06 | 0.06 | 0.06 | 0.06 | 0.06 |

TABLE 5-continued

| Pt/B-beta Reforming Catalysts Containing Cesium | No Cesium | | 0.1 wt. % Cesium | | 0.15 wt. % Cesium | |
|---|---|---|---|---|---|---|
| Molar Al/Cs Ratio | — | — | 2.95 | 2.95 | 1.97 | 1.97 |

Note:
Aromatic Selectivity = 100*(% Aromatics in Product/% Total Conversion)

TABLE 6

| Pt/B-beta Reforming Catalysts Containing Cesium | 0.2 wt % Cesium | | 0.5 wt. % Cesium | | 1.0 wt. % Cesium | |
|---|---|---|---|---|---|---|
| Reaction Temperature, °F. | 800 | 800 | 800 | 800 | 800 | 800 |
| Reaction Pressure, psig | 200 | 50 | 200 | 200 | 200 | 200 |
| Dimethylcyclopentane Conversion, % | 84.7 | 74.9 | 32.9 | 76.1 | 29.2 | 75.2 |
| Total Feed Conversion, % | 43.0 | 42.2 | N/A | N/A | N/A | N/A |
| Aromatization Selectivity, % | 34.7 | 48.2 | N/A | N/A | N/A | N/A |
| Product Analysis | | | | | | |
| Butanes, wt. % | 5.79 | 3.75 | 0.50 | 3.22 | 0.47 | 3.42 |
| $C_{5+}$ Yield, wt. % | 87.6 | 91.1 | 98.8 | 92.9 | 98.8 | 92.5 |
| Research Octane (calc.) | 73.3 | 75.2 | 65.9 | 69.1 | 65.7 | 68.9 |
| Aluminum, wt. % | 0.06 | 0.06 | 0.06 | 0.06 | 0.06 | 0.06 |
| Molar Al/Cs Ratio | 1.48 | 1.48 | 0.60 | 0.60 | 0.30 | 0.30 |

Notes:
N/A = Conversion calculation does not apply. Conversion of some feed components is negative.
Aromatic Selectivity = 100*(% Aromatics in Product/% Total Conversion)

TABLE 7

| Effect of Cation on Pt/B-beta Reforming Catalysts | No Cation | | 0.01 wt. % Lithium | | 0.035 wt. % Sodium | |
|---|---|---|---|---|---|---|
| Reaction Temperature, °F. | 800 | 800 | 800 | 800 | 800 | 800 |
| Reaction Pressure, psig | 200 | 50 | 200 | 50 | 200 | 50 |
| Dimethylcyclopentane Conversion, % | 94.2 | 99.4 | 92.8 | 99.3 | 92.4 | 98.8 |
| Total Feed Conversion, % | 72.1 | 83.3 | 62.2 | 75.2 | 55.3 | 65.6 |
| Aromatization Selectivity, % | 39.7 | 52.7 | 49.1 | 55.4 | 57.0 | 60.2 |
| Product Analysis | | | | | | |
| Butanes, wt. % | 17.17 | 15.49 | 10.77 | 12.00 | 6.75 | 8.11 |
| $C_{5+}$ Yield, wt. % | 67.30 | 68.80 | 78.70 | 75.40 | 85.90 | 82.80 |
| Research Octane (calc.) | 85.10 | 95.00 | 82.90 | 90.80 | 81.50 | 86.90 |

Note:
Aromatic Selectivity = 100*(% Aromatics in Product/% Total Conversion)

TABLE 8

| Effect of Cation on Pt/B-beta Reforming Catalysts | 0.059 wt % Potassium | | 0.20 wt. % Cesium | | 0.21 wt. % Barium | |
|---|---|---|---|---|---|---|
| Reaction Temperature, °F. | 800 | 800 | 800 | 800 | 800 | 800 |
| Reaction Pressure, psig | 200 | 50 | 200 | 50 | 200 | 50 |
| Dimethylcyclopentane Conversion, % | 92.0 | 97.9 | 92.3 | 97.4 | 91.1 | 95.5 |
| Total Feed Conversion, % | 54.3 | 65.3 | 55.3 | 68.0 | 51.5 | 62.8 |
| Aromatization Selectivity, % | 55.2 | 59.9 | 51.9 | 57.7 | 54.0 | 59.6 |
| Product Analysis | | | | | | |
| Butanes, wt. % | 6.27 | 7.24 | 6.79 | 7.85 | 5.48 | 6.26 |
| $C_{5+}$ Yield, wt. % | 86.5 | 83.8 | 85.30 | 82.40 | 87.8 | 85.5 |
| Research Octane (calc.) | 80.6 | 86.5 | 80.40 | 87.20 | 79.3 | 85.2 |

Note:
Aromatic Selectivity = 100*(% Aromatics in Product/% Total Conversion)

What is claimed is:

1. A catalytic reforming process which comprises contacting a hydrocarbonaceous feedstream under catalytic reforming conditions with a composition comprising larger-pore borosilicate zeolites having a pore size greater than 6 and less than 8 angstroms containing less than 1000 parts per million aluminum.

2. A process in accordance with claim 1 wherein said large-pore borosilicate zeolites are boron beta zeolite, boron SSZ-24, boron SSZ-31, and SSZ-33.

3. A process in accordance with claim 1 or 2 wherein the boron in the large-pore borosilicate zeolites is partially replaced by a Group IIIA metal, or a first row transition metal.

4. A process in accordance with claim 3 wherein the replacing metal is cobalt, zinc, aluminum, gallium, iron, nickel, tin and titanium.

5. A process in accordance with claim 1 or 2 wherein the hydrogenation/dehydrogenation component of said large-pore borosilicate zeolites is a Group VIII metal.

6. A process in accordance with claim 3 wherein the hydrogenation/dehydrogenation component of said large-pore borosilicate is a Group VIII metal.

7. A process in accordance with claim 5 wherein the hydrogenation/dehydrogenation component of said large-pore borosilicate zeolite comprises platinum.

8. A process in accordance with claim 5 wherein said large-pore borosilicate zeolite contains an alkali metal component.

9. A process in accordance with claim 1 or 2 wherein the hydrogenation/dehydrogenation component of said large-pore borosilicate zeolite comprises rhenium and platinum.

10. A process in accordance with claim 4 wherein the hydrogenation/dehydrogenation component of said large-pore borosilicate zeolite comprises rhenium and platinum.

11. A process in accordance with claim 1 or 2 wherein the hydrogenation/dehydrogenation component of said large-pore borosilicate zeolites comprises platinum and tin.

12. A process in accordance with claim 4 wherein the hydrogenation/dehydrogenation component of said large-pore borosilicate zeolite comprises platinum and tin.

13. A process in accordance with claim 1 or 2 comprising using a fixed, moving or fluid bed reformer.

14. A process in accordance with claim 1 or 2 which is a multi-stage catalytic reforming process.

15. A process in accordance with claim 14 where the large-pore borosilicate zeolite is used in the last reactor to convert the remaining light paraffins not converted by the Pt Re/$Al_2O_3$ or Pt Sn/$Al_2O_3$ catalysts used in the upstream reactors.

16. A process in accordance with claim 14 where the large-pore borosilicate zeolite is used in the last stage of a multi-stage catalytic reforming process where the operating pressure of the last stage is much lower than the upstream stage.

17. A process in accordance with claim 16 where the large-pore borosilicate zeolite is used in the last stage of a multi-stage catalytic reforming process where the operating pressure of the last stage is much lower than the upstream stage.

18. A catalytic reforming process which comprises contacting a hydrocarbonaceous feedstream under catalytic reforming conditions with a composition comprising boron beta zeolite containing less than 1000 parts per million aluminum, a Group VIII metal component, and a Group IA or Group IIA metal cation wherein the molar ratio of aluminum to Group IA or Group IIA metal cation is between about 1.0 and 4.0.

19. A process in accordance with claim 18 wherein the large-pore borosilicate zeolite contains a binder.

20. A process in accordance with claim 18 wherein the large-pore borosilicate zeolite contains a silica-based or alumina-based binder.

21. A catalytic reforming process which comprises contacting a hydrocarbonaceous feedstream under catalytic reforming conditions with a composition comprising boron SSZ-24 containing less than 1000 parts per million aluminum, a Group VIII metal component, and a Group IA or Group IIA metal cation wherein the molar ratio of aluminum to Group IA or Group IIA metal cation is between about 1.0 and 4.0.

22. A catalytic reforming process which comprises contacting a hydrocarbonaceous feedstream under catalytic reforming conditions with a composition comprising boron SSZ-31 containing less than 1000 parts per million aluminum, a Group VIII metal component, and a Group IA or Group IIA metal cation wherein the molar ratio of aluminum to Group IA or Group IIA metal cation is between about 1.0 and 4.0.

23. A catalytic reforming process which comprises contacting a hydrocarbonaceous feedstream under catalytic reforming conditions with a composition comprising SSZ-33 containing less than 1000 parts per million aluminum, a Group VIII metal component, and a Group IA or Group IIA metal cation wherein the molar ratio of aluminum to Group IA or Group IIA metal cation is between about 1.0 and 4.0.

24. The process in accordance with claim 18, 21, 22 or 23 wherein the amount of Group VIII metal component is between about 0.1 and 2 wt. %.

25. The process in accordance with claim 18, 21, 22 or 23 wherein the Group VIII metal component is platinum.

26. The process in accordance with claim 18 wherein the Group IA cation is cesium, lithium, potassium or sodium.

27. The process in accordance with claim 18 wherein the Group IIA cation is barium, calcium, magnesium or strontium.

28. A catalytic reforming process which comprises contacting a hydrocarbonaceous feedstream under catalytic reforming conditions with a composition comprising boron beta zeolite containing less than 1000 parts per million aluminum, a platinum metal component, and a cesium cation wherein the molar ratio of aluminum to cesium is between about 1.0 and 4.0.

29. A catalytic reforming process which comprises contacting a hydrocarbonaceous feedstream under catalytic reforming conditions with a composition comprising boron SSZ-24 containing less than 1000 parts per million aluminum, a platinum metal component, and a cesium cation wherein the molar ratio of aluminum to cesium is between about 1.0 and 4.0.

30. A catalytic reforming process which comprises contacting a hydrocarbonaceous feedstream under catalytic reforming conditions with a composition comprising boron SSZ-31 containing less than 1000 parts per million aluminum, a platinum metal component, and a cesium cation wherein the molar ratio of aluminum to cesium is between about 1.0 and 4.0.

31. A catalytic reforming process which comprises contacting a hydrocarbonaceous feedstream under catalytic reforming conditions with a composition comprising SSZ-33 containing less than 1000 parts per million aluminum, a platinum metal component, and a cesium cation wherein the molar ratio of aluminum to cesium is between about 1.0 and 4.0.

* * * * *